US008360752B2

(12) United States Patent
Watanabe et al.

(10) Patent No.: US 8,360,752 B2
(45) Date of Patent: Jan. 29, 2013

(54) ELECTRIC COMPRESSOR

(75) Inventors: Toshiharu Watanabe, Sano (JP); Yutaka Satou, Saitama (JP); Hirotada Shimaguchi, Kuki (JP); Masaki Watanabe, Oyama (JP)

(73) Assignee: Calsonic Kansei Corporation, Saitama-shi (JP)

( * ) Notice: Subject to any disclaimer, the term of this patent is extended or adjusted under 35 U.S.C. 154(b) by 486 days.

(21) Appl. No.: 12/442,062

(22) PCT Filed: Feb. 15, 2008

(86) PCT No.: PCT/JP2008/052512

§ 371 (c)(1),
(2), (4) Date: Jun. 15, 2009

(87) PCT Pub. No.: WO2008/102697

PCT Pub. Date: Aug. 28, 2008

(65) Prior Publication Data

US 2010/0021320 A1 Jan. 28, 2010

(30) Foreign Application Priority Data

Feb. 20, 2007 (JP) ..... 2007-038841
Jul. 12, 2007 (JP) ..... 2007-183102

(51) Int. Cl.
*F04B 17/00* (2006.01)
*F04B 35/04* (2006.01)

(52) U.S. Cl. ..... 417/410.3; 417/410.1; 417/422

(58) Field of Classification Search ..... 417/410.1, 417/572, 410.5, 410.3, 422; 439/527
See application file for complete search history.

(56) References Cited

U.S. PATENT DOCUMENTS

| | | | | |
|---|---|---|---|---|
| 3,671,920 | A * | 6/1972 | Iantorno et al. | 439/550 |
| 3,988,053 | A * | 10/1976 | Dodenhoff | 439/887 |
| 6,733,251 | B2 | 5/2004 | Sakurabayashi et al. | |
| 6,808,372 | B2 * | 10/2004 | Makino et al. | 417/410.5 |
| 6,866,487 | B2 * | 3/2005 | Abe et al. | 417/410.1 |
| 7,147,443 | B2 | 12/2006 | Ogawa et al. | |
| 2003/0002998 | A1 | 1/2003 | Makino et al. | |

FOREIGN PATENT DOCUMENTS

| | | | |
|---|---|---|---|
| CN | 1253661 | C | 4/2006 |
| JP | 62-26154 | U | 2/1987 |
| JP | 2002-364536 | A | 12/2002 |
| JP | 2002-364546 | A | 12/2002 |
| JP | 2005-256700 | A | 9/2005 |
| JP | 2006-177231 | A | 7/2006 |

* cited by examiner

*Primary Examiner* — Peter J Bertheaud
(74) *Attorney, Agent, or Firm* — Foley & Lardner LLP

(57) ABSTRACT

The present invention relates to an electric compressor integrally including a compression mechanism and an electric motor, and an object thereof is to prevent the housing from being elongated in the axial direction and improve the sealability and the mountability of the compression mechanism. According to the present invention, a hermetic terminal (45) electrically connecting the electric motor (30) and a motor drive circuit (40) is attached within a swelled-space portion (50) swelled toward radial outside of a housing (11) so as to be continuous with a mounting bracket (17) of the housing (11). Accordingly, the distance between the compression mechanism and motor drive circuit can be shortened.

3 Claims, 5 Drawing Sheets

ELECTRIC COMPRESSOR

TECHNICAL FIELD

The present invention relates to an electric compressor integrally including a compression mechanism and an electric motor.

BACKGROUND ART

Conventionally known electric compressors which integrally includes a compression mechanism and an electric motor driving the same further includes a motor drive circuit for controlling energization to the electric motor (Patent Citation 1). In the electric compressor disclosed in Patent Citation 1, the electric motor, the compression mechanism configured as a scroll pump, and the motor drive circuit are accommodated in a closed tubular housing (a body casing) in this order starting from the end wall side. An open end provided on a side of the housing axially opposite to the end wall is closed by an end plate. On the outside of the housing, a plurality of mounting brackets (mounting feet) are protruded, by which the electric compressor is mounted on the side surface of an internal combustion engine.

The motor drive circuit accommodated in the open end side of the housing is electrically connected to the electric motor accommodated in the end wall side through a harness with the compression mechanism interposed therebetween. The harness is provided with a connecting terminal, which is located between the motor drive circuit and compression mechanism on the inner circumference of the housing.

However, in the aforementioned conventional electric compressor, the connecting terminal is placed between the motor drive circuit and compression mechanism within the housing. Accordingly, it is necessary to provide a space for placing the connecting terminal between the motor drive circuit and compression mechanism. This results in an increase in axial length of the housing, thus increasing the axial size of the electric compressor.

Moreover, the connecting terminal is just attached so as to protrude within the housing. Accordingly, the connecting terminal is easily swung with inputted vibration or the like and may be difficult to seal.

Furthermore, the connecting terminal protrudes from the compression mechanism toward the open end of the housing. This can cause degradation of the mountability of the compression mechanism from the open end side.

An object of the present invention is to provide an electric compressor in which the sealability and the mountability of the compression mechanism can be improved while the housing is prevented from being elongated in the axial direction.

Patent Citation 1: Japanese Patent Unexamined Publication No. 2005-256700

DISCLOSURE OF INVENTION

According to the present invention, an electric compressor includes: a compression mechanism which compresses introduced fluid; an electric motor which drives the compression mechanism; a motor drive circuit which controls energization to the electric motor; a housing which accommodates at least any one of the compression mechanism, electric motor, and motor drive circuit; and a mounting bracket which is partially protruded on an outside of the housing. In the electric compressor, the housing includes a swelled-space portion swelled toward radial outside of the housing to be continuous with the mounting bracket, and within the swelled-space portion, a connecting terminal which electrically connects the electric motor and the motor drive circuit is attached.

Moreover, in the present invention, the connecting terminal includes: a body portion; a terminal portion which protrudes from the body portion on an electric motor side; and a terminal portion which protrudes from the body portion on a motor drive circuit side. Any one of the terminal portion of the connecting terminal on the electric motor side and a terminal portion at an end of a harness electrically connected to the electric motor may be bifurcated, and also may sandwich the other to constitute a connection structure.

Furthermore, in the present invention, one of the terminal portions of the connecting terminal on the electric motor side and on the motor drive circuit side which is located on a mounting bracket side may be positioned diagonally to an axial direction toward radial center of the housing to avoid the mounting bracket.

Still furthermore, in the present invention, the housing may include a rear casing which accommodates the electric motor; a middle casing which accommodates the compression mechanism; and a front casing which accommodates the motor drive circuit. The front and rear casings are connected to each other with the middle casing interposed therebetween. The swelled-space portion is formed in the front casing or in both the front and middle casings. And, the connecting terminal is attached to the middle casing.

BEST MODE FOR CARRYING OUT THE INVENTION

Hereinafter, a description is given of preferred embodiments of the present invention in detail with reference to the drawings. The embodiments are examples of an electric compressor applied to a refrigerating cycle of an air conditioner of a vehicle. In this case, fluid compressed by the electric compressor is a refrigerant of the refrigerating cycle.

First Embodiment

Figure 1:
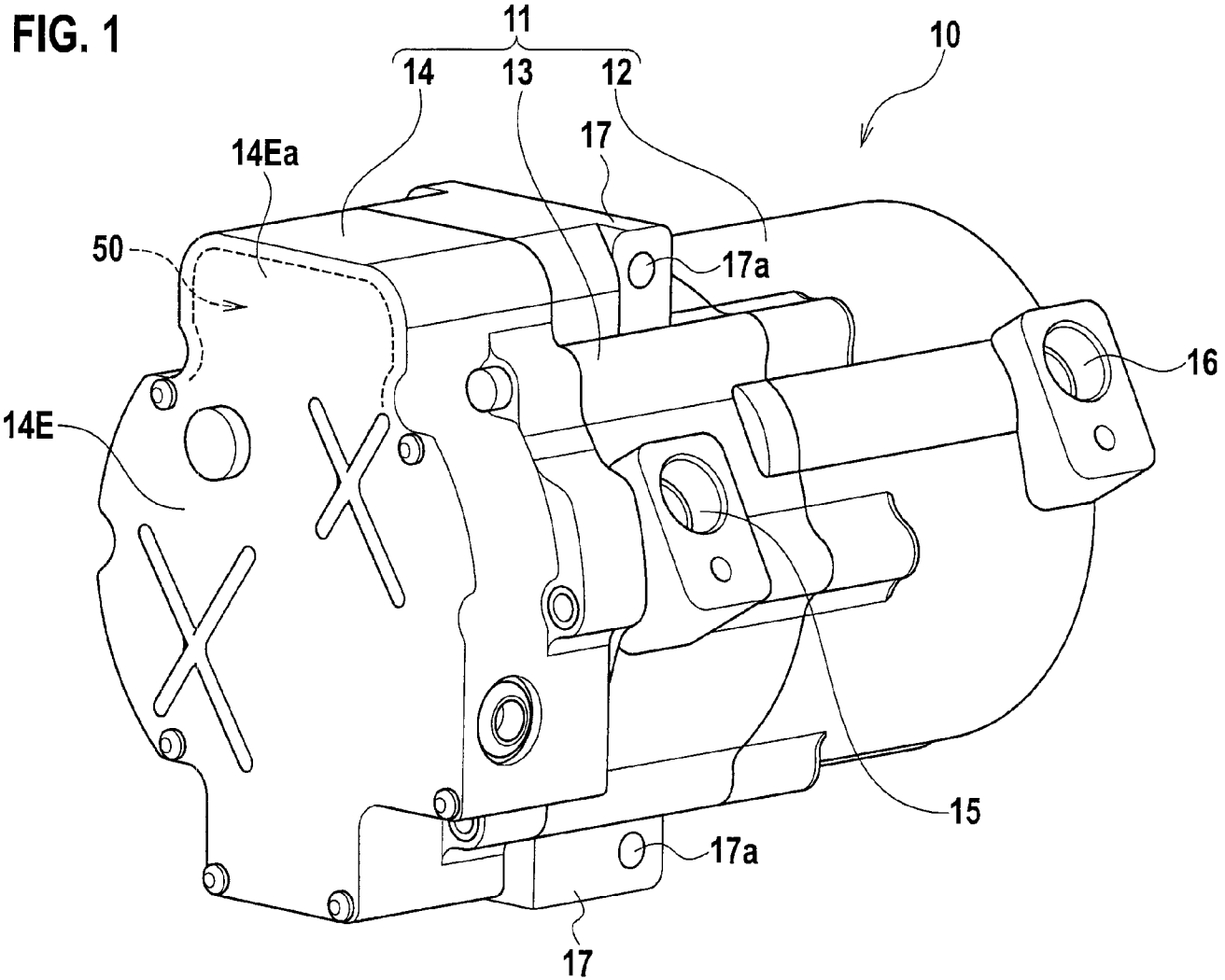
FIG. 1 is a perspective view of a whole electric compressor according to an embodiment of the present invention.
Figure 2:
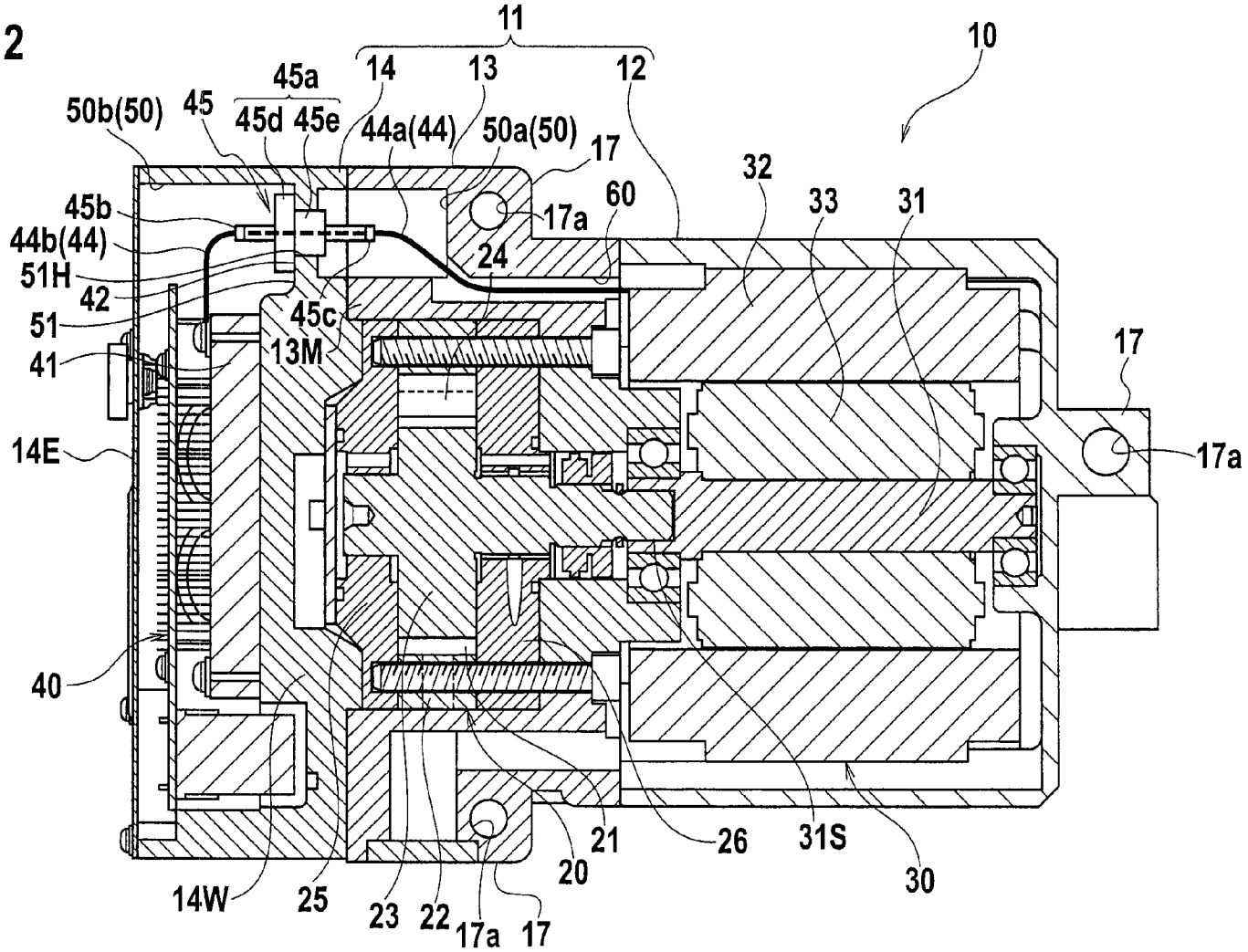
FIG. 2 is a longitudinal cross-sectional view of the electric compressor according to the embodiment of the present invention.

FIG. 1 is a perspective view of a whole electric compressor according to the embodiment, and FIG. 2 is a longitudinal cross-sectional view of the electric compressor.

In an electric compressor 10 according to this embodiment, as shown in FIGS. 1 and 2, a rear casing 12, a middle casing 13, and a front casing 14, which are separated in the axial direction (in the horizontal direction of FIG. 2), are joined to each other to constitute a housing 11. As shown in FIG. 2, the middle casing 13 accommodates a compression mechanism 20; the rear casing 12 accommodates an electric motor 30; and the front casing 14 accommodates a motor drive circuit 40 controlling energization to the electric motor 30.

As shown in FIG. 1, the refrigerant introduced into the housing 11 through an introduction port 15 formed in the middle casing 13 is compressed by the compression mechanism 20 and is then discharged through a discharge port 16 formed in the rear casing 12.

The compression mechanism 20 is configured as a rotary type with vanes. The compression mechanism 20 schematically includes a cylinder block 22, a compressor rotor 23, a plurality of vanes 24, and inlet and outlet side blocks 25 and 26 as shown in FIG. 2. The cylinder block 22 includes a cylinder chamber 21 formed in a non-circular shape with a smooth inner circumference. The compressor rotor 23 is rotatably accommodated in the cylinder chamber 21. The vanes 24 are provided on the outer circumference of the compressor rotor 23 so as to be freely retracted and are arranged circumferentially at predetermined intervals. The tips of the vanes 24 slide on the inner circumferential surface of the cylinder chamber 21. The inlet and outlet side blocks 25 and 26 are arranged on the both sides of the cylinder block 22 in the axial direction and close both axial ends of the cylinder chamber 21. The compressor rotor 23 slides on the inlet and outlet side blocks 25 and 26.

In the inlet side block 25 on the left side of FIG. 2, an inlet port (not shown) is formed so that the refrigerant introduced from the introduction port 15 is introduced into the cylinder chamber 21 through the inlet port. In outer peripheral part of the cylinder block 22 or the right outlet side block 26, an outlet port (not shown) is formed, through which the compressed refrigerant in the cylinder chamber 21 is discharged.

Accordingly, in the compression mechanism 20, the compressor rotor 23 is rotated with a driveshaft 31 of the electric motor 30 to change the circumferential volume of the cylinder chamber 21 while retracting and advancing the vanes 24. The refrigerant at low pressure which is sucked into the cylinder 21 through the inlet port is compressed, and the compressed refrigerant at high pressure is discharged through the outlet port.

The refrigerant at high pressure discharged from the outlet port passes through a channel between the inner circumference of the middle casing 13 and the compression mechanism 20 and then passes through the rear casing 12 accommodating the electric motor 30 to be discharged from the discharge port 16. At this time, the refrigerant passing through the rear casing 12 cools part of the electric motor 30 generating heat.

The electric motor 30 includes a cylindrical stator 32 pressed and fixed to the inner circumference of the rear casing 12 and a rotor 33 rotatably accommodated in the stator 32. A plurality of coil portions provided in the stator 32 circumferentially at constant intervals are energized to excite the stator 32, thus rotating the rotor 33.

In the center of the rotor 33, the driveshaft 31 is inserted and engaged so as not to move in a rotating direction relative to the rotor 33. An end (the left end in the drawing) of the driveshaft 31 is coupled with an end (the right end in the drawing) of the compressor rotor 23 of the compression mechanism 20 with a non-circular fitting portion 31S. The rotation of the driveshaft 31 is thus transmitted to the compressor rotor 23.

In the middle casing 13 side of the front casing 14, as shown in FIG. 2, a partition wall 14W is provided, which closes the open end (the left end of the drawing) of a support wall 13M of the compression mechanism 20. The other end of the front casing 14 is opened. The open end of the front casing 14 is closed by an end plate 14E after the motor drive circuit 40 is accommodated in the front casing 14 from the open side.

The motor drive circuit 40 is provided with a circuit board 41. On the circuit board 41, an inverter including electronic parts such as a switching device switching on and off of a circuit (for example, a MOS-FET, an IGBT, or the like) is mounted.

The motor drive circuit 40 and the coil portions provided in the stator 32 of the electric motor 30 are electrically connected through a harness 44. In the middle of the harness 44, a hermetic terminal 45 as a connecting terminal is provided. Specifically, a harness (wire) 44*b* from the motor drive circuit 40 and a harness (wire) 44*a* from the electric motor 30 are connected by the hermetic terminal 45.

The hermetic terminal 45 includes a body portion 45*a*, a terminal portion 45*c* protruding from the body portion 45*a* on the electric motor 30 side, and a terminal portion 45*b* protruding from the body portion 45*a* on the motor drive circuit 40 side.

The body portion 45*a* includes a cylindrical insertion portion 45*e* and a disk-shaped flange 45*d* protruding from an end of the insertion portion 45*e* radially outward. The terminal portions 45*c* and 45*b* are electrically connected so as to penetrate the body portion 45*a*.

On the outside of the housing 11, mounting brackets 17 are partially protruded, with which the electric compressor 10 is mounted in an engine room, for example, on a cylinder block of the engine or the like.

The mounting brackets 17 are protruded at total three places at the top and bottom of the middle casing 13 (see FIGS. 1 and 2) and an end of the rear casing 12 (see FIG. 2). Each of the mounting brackets 17 is integrally protruded on the outer circumference of the middle or rear casing 13 or 12 in a rib shape. In each mounting bracket 17, a mounting hole 17*a* is formed, through which a mounting bolt (not shown) is inserted so as to penetrate perpendicular to the axial direction of the housing 11.

In this embodiment, the housing 11 is provided with a swelled-space portion 50 swelled toward the radial outside of the housing 11, or in the direction perpendicular to the axis of the housing 11 so as to be continuous with the above mounting bracket 17. In the swelled-space portion 50, the hermetic terminal 45 is provided.

The mounting bracket 17 provided for the swelled-space portion 50 is placed at the top of the middle casing 13. A part of the middle casing 13 located on the front casing 14 side of the above mounting bracket 17 and entire top part of the front casing 14 are swelled integrally from the mounting bracket 17 so as to have a substantially same height as that of the mounting bracket 17. Thus, the swelled portion serves as the swelled-space portion 50.

As shown in FIG. 2, the swelled-space portion 50 is partitioned in the axial direction of the housing 11 with an extension wall 51 which is an extension of the partition wall 14W of the front casing 14.

A space 50*b* of the swelled-space portion 50 located on the front casing 14 side of the extension wall 51 is continuous with internal space of the front casing 14.

A space 50*a* of the swelled-space portion 50 located on the middle casing 13 side of the extension wall 51 communicates with internal space of the rear casing 12 accommodating the electric motor 30 through a communication hole 60 penetrating the middle casing 13. The space 50*a* is partitioned from internal space of the support wall 13M by the support wall 13M of the compression mechanism 20.

The hermetic terminal 45 positioned in the swelled-space portion 50 is configured to be attached to the extension wall 51. In the extension wall 51, an insertion hole 51H of the hermetic terminal 45 is penetrated. The hermetic terminal 45 is placed across the extension wall 51 within the swelled-space portion 50 through the insertion hole 51H.

The hermetic terminal 45 is attached to the extension wall 51 in the state where the insertion portion 45*e* is inserted in the insertion hole 51H of the extension wall 51 and the flange 45 is in close contact with the periphery of the insertion hole 51H of the extension wall 51 (a seal surface 42). The insertion hole 51H is thus air-tightly closed.

The space 50*a* of the swelled-space portion 50 located on the middle casing side of the extension wall 51 communicates with the internal space of the rear casing 12 through the communication hole 60. Accordingly, the refrigerant or oil compressed by the compression mechanism 20 enters the space 50*a*.

As described above, according to the electric compressor 10 of this embodiment, the hermetic terminal 45 is attached within the swelled-space portion 50 swelled toward the radial outside of the housing 11. Accordingly, the hermetic terminal 45 is prevented from interfering with the compression mechanism 20 accommodated in the middle casing 13, the motor drive circuit 40 accommodated in the front casing 14, or the like.

The axial distance between the compression mechanism 20 and the motor drive circuit 40 can be therefore shortened. This makes it possible to shorten the axial length of the housing 11, thus preventing the electric compressor 10 from increasing in axial size.

Furthermore, the swelled-space portion 50 in which the hermetic terminal 45 is attached is swelled to be continuous with the mounting bracket 17. Accordingly, the mounting bracket 17 having high strength can enhance the strength of the swelled-space portion 50 itself.

The swelled-space portion 50 with enhanced strength can increase the rigidity to support the hermetic terminal 45. This eliminates the need to reinforce the seal portion at sealing the hermetic terminal 45, thus facilitating sealing.

Furthermore, the hermetic terminal 45 is placed in the swelled-space portion 50 swelled from the housing 11. This can prevent the hermetic terminal 45 from protruding within the housing 11. Accordingly, the hermetic terminal 45 does not interfere with assembly of the compression mechanism 20 or motor drive circuit 40. It is therefore possible to prevent degradation of the mountability of the compression mechanism 20 and motor drive circuit 40.

Second Embodiment

Figure 3:
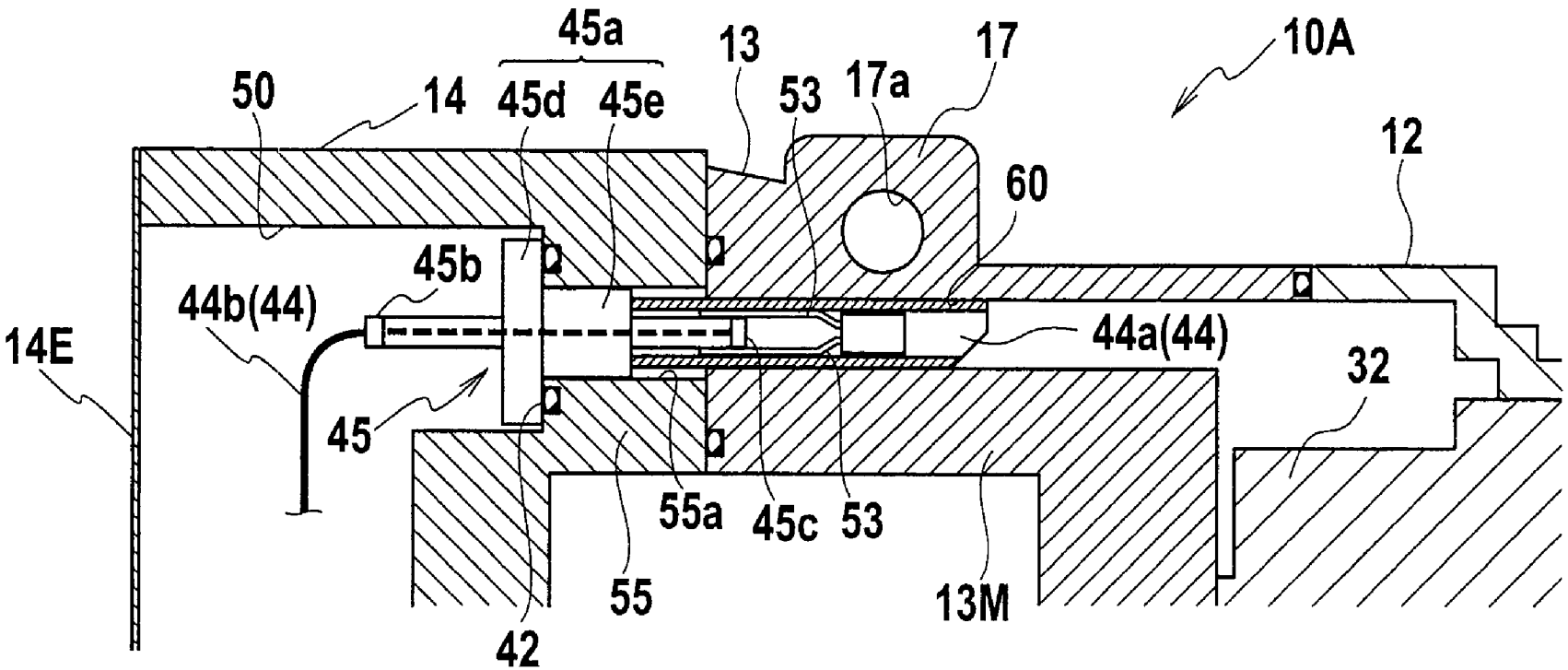
FIG. 3 is an enlarged view of a hermetic terminal part according to a second embodiment of the present invention.

FIG. 3 is an enlarged view of the vicinity of a connecting terminal of an electric compressor according to this embodiment. An electric compressor 10A includes the same constituent elements as those of the electric compressor 10 according to the first embodiment. Hereinafter, the same constituent elements are given the same reference numerals, and the redundant description thereof is omitted.

The electric compressor 10A according to this embodiment differs from the electric compressor 10 according to the first embodiment in that the swelled-space portion 50 is not formed in both the front to middle casings 14 and 13 but formed in the front casing 14.

In the peripheral wall of the swelled-space portion 50 of the front casing 14, an insertion hole 55*a* to which the hermetic terminal 45 is attached is formed in a wall portion 55 joined to the end surface of the middle casing 13. Moreover, the communication hole 60 is penetrated in the middle casing 13. The swelled-space portion 50 and the rear casing internal space communicate with each other through the insertion hole 55*a* and communication hole 60.

In the communication hole 60, the harness 44*a* from the electric motor 30 is inserted, and a terminal portion 53 thereof is bifurcated.

When the hermetic terminal 45 is attached to the insertion hole 55*a*, the terminal portion 45*c* on the electric motor 30 side protrudes into the communication hole 60 through the insertion hole 55*a* and is connected to the terminal portion 53 of the harness 44 from the electric motor 30.

As described above, in the electric compressor 10A of this embodiment, the terminal portion 53 at the end of the harness 44*a* from the electric motor 30 is bifurcated to sandwich the terminal portion 45*c* of the connecting terminal 45 on the electric motor 30 side.

With such a configuration, the connecting work can be performed by one-touch operation, thus improving the working performance.

Third Embodiment

Figure 4:
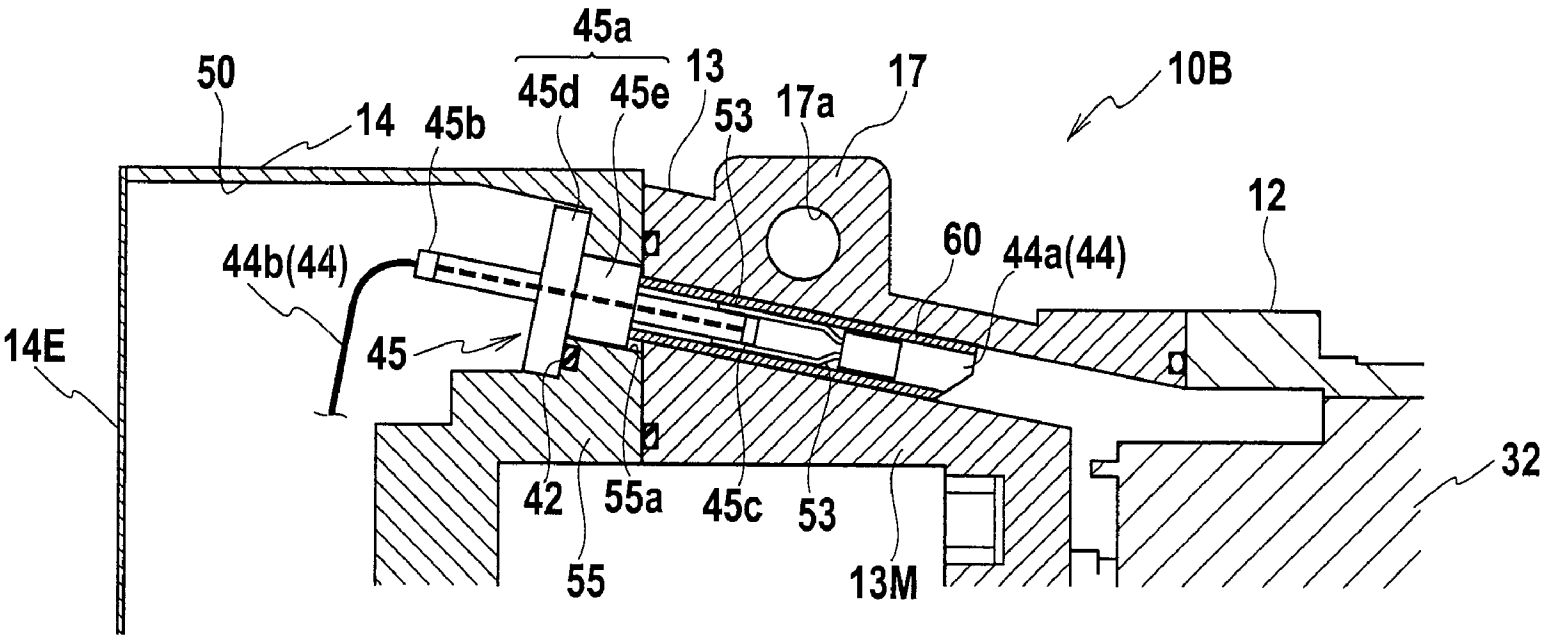
FIG. 4 is an enlarged view of a hermetic terminal part according to a third embodiment of the present invention.

FIG. 4 is an enlarged view of the vicinity of a connecting terminal of an electric compressor according to this embodiment. Hereinafter, the same constituent elements as those of the second embodiment are given the same reference numerals, and the redundant description thereof is omitted.

As shown in FIG. 4, in an electric compressor 10B according to this embodiment, the terminal portion 45*c* of the hermetic terminal 45 on the mounting bracket 17 side is positioned diagonally to the axial direction toward the radial center of the housing 11 so as to avoid the mounting bracket 17.

Such a structure allows the hermetic terminal 45 and mounting bracket to be mounted without further increasing space within the housing 11. In other words, the hermetic terminal 45 and the mounting bracket 17 can be arranged close to each other in the axial direction. The housing 11 can be accordingly miniaturized.

Fourth Embodiment

Figure 5:
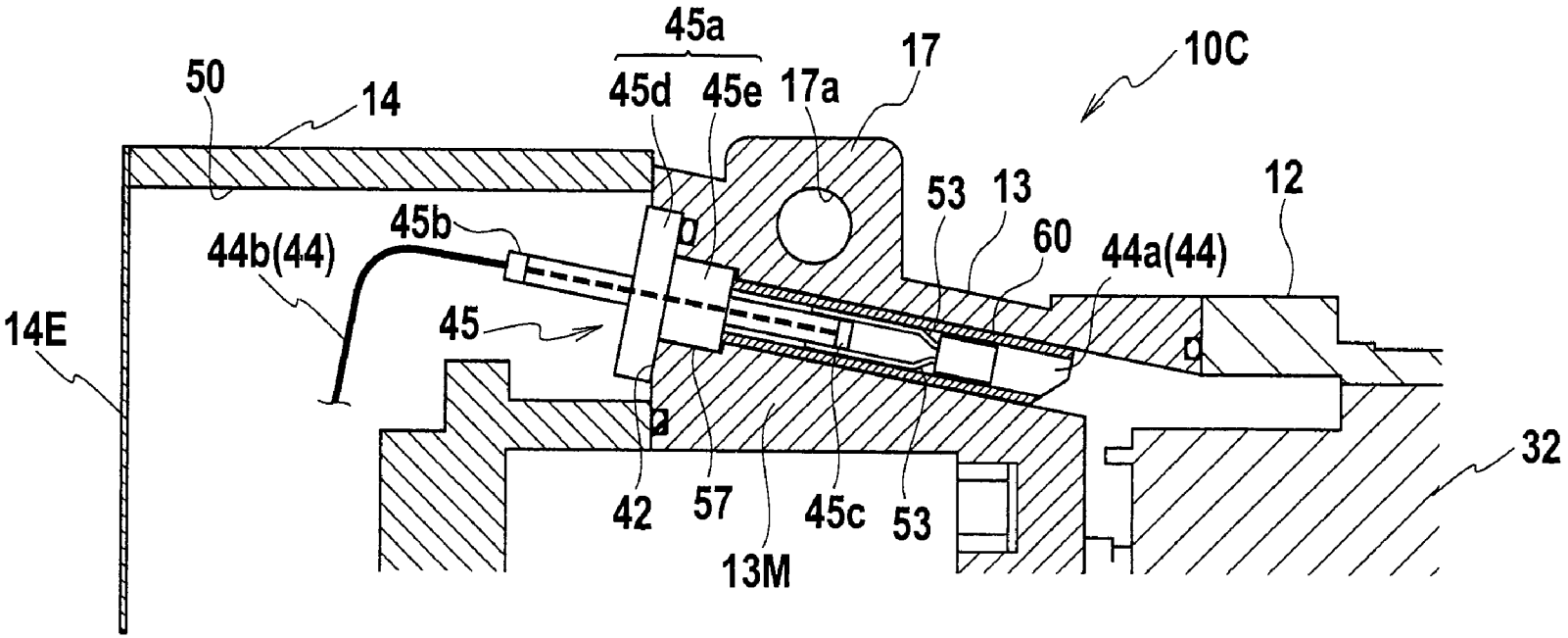
FIG. 5 is an enlarged view of a hermetic terminal part according to a fourth embodiment of the present invention.

FIG. 5 is an enlarged view of the vicinity of a connecting terminal of an electric compressor according to this embodiment. Hereinafter, the same constituent elements are given the same reference numerals as those of the second or third embodiment, and the redundant description thereof is omitted.

The electric compressor 10C according to this embodiment differs from the electric compressors 10A and 10B according to the above second and third embodiments in that the hermetic terminal 45 is attached to the middle casing 13.

Specifically, an insertion hole 57 through which the insertion portion 45*e* of the hermetic terminal 45 is inserted is formed in the middle casing 13. Moreover, the seal surface 42 which comes into close contact with the flange 45*d* of the hermetic terminal 45 is also formed in the middle casing 13.

With such a structure, the distance between the hermetic terminal 45 and the motor drive circuit 40 within the front casing 14 can be increased. Accordingly, it is possible to prevent the harness 44*b* connecting the hermetic terminal 45 and the motor drive circuit 40 from bending sharply, thus leading to an increase in reliability of the harness 44*b*. Moreover, it is possible to reduce redundant space in the front casing 14 and miniaturize the electric compressor.

FIGS. 3 to 5 show partial views of the harness 44*a* from the motor drive circuit 44 and the harness 44*b* from the electric motor.

Hereinabove, the description is given of the preferred embodiments of the present invention. However, the present invention is not limited to the aforementioned embodiments and can be variously modified. For example, the present invention is not limited to the electric compressor used for a refrigerating cycle of the air conditioner, and the fluid treated in the electric compressor is not limited to the refrigerant.

Moreover, the compressor may be an eccentric roller type rotary compressor or may be other than the rotary compressors.

INDUSTRIAL APPLICABILITY

The present invention is available for electric compressors.

The invention claimed is:

1. An electric compressor comprising:

a compression mechanism which compresses introduced fluid;

an electric motor which drives the compression mechanism;

a motor drive circuit which controls energization to the electric motor;

a housing which accommodates at least any one of the compression mechanism, electric motor, and motor drive circuit; and a mounting bracket which is partially protruded on an outside of the housing, wherein:

the housing comprises a swelled-space portion swelled toward a radial outside of the housing to be continuous with the mounting bracket, and within the swelled-space portion, a connecting terminal, which electrically connects the electric motor and the motor drive circuit, is attached, the connecting terminal comprises: a body portion; a first terminal portion which protrudes from the body portion on an electric motor side; and a second terminal portion which protrudes from the body portion on a motor drive circuit side, one of the first terminal portion and a third terminal portion at an end of a harness electrically connected to the electric motor is bifurcated and sandwiches the other of the first terminal portion and the third terminal portion to constitute a connection structure, the third terminal portion is fixed within the housing, and the first terminal portion is automatically coupled to the third terminal portion upon attachment of the connecting terminal to the swelled-space portion.

2. An electric compressor according to claim 1, wherein one of the first and second terminal portions which is located on a mounting bracket side is positioned diagonally to an axial direction toward a radial center of the housing to avoid the mounting bracket.

3. An electric compressor according to claim 1, wherein:

the housing comprises: a rear casing which accommodates the electric motor; a middle casing which accommodates the compression mechanism; and a front casing which accommodates the motor drive circuit, the front and rear casings are connected to each other with the middle casing interposed between the front and rear casings, the swelled-space portion is formed in the front casing or in both the front and middle casings, and the connecting terminal is attached to the middle casing.

* * * * *